US006367762B1

(12) United States Patent
Koban

(10) Patent No.: US 6,367,762 B1
(45) Date of Patent: Apr. 9, 2002

(54) BASE FOR SECURING SHAPED RODS

(75) Inventor: Johannes Koban, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/341,058

(22) PCT Filed: Nov. 12, 1998

(86) PCT No.: PCT/DE98/03320

§ 371 Date: Jul. 2, 1999

§ 102(e) Date: Jul. 2, 1999

(87) PCT Pub. No.: WO99/27215

PCT Pub. Date: Jun. 3, 1999

(30) Foreign Application Priority Data

Nov. 19, 1997 (DE) ..... 297 20 482
Sep. 16, 1998 (DE) ..... 198 42 297

(51) Int. Cl.[7] ..... F16M 13/00
(52) U.S. Cl. ..... 248/519; 248/523; 248/511
(58) Field of Search ..... 248/519, 523, 248/524, 511

(56) References Cited

U.S. PATENT DOCUMENTS 1,386,947 A 8/1921 Quinn ..... 248/539
3,020,023 A * 2/1962 MacIntyre et al. ..... 248/519
3,776,521 A * 12/1973 Weinert ..... 256/24
4,079,559 A * 3/1978 Tenbrummeler ..... 248/519
4,275,535 A * 6/1981 Stalzer ..... 248/519
5,029,820 A * 7/1991 Katz ..... 403/369
5,094,422 A * 3/1992 Tiffany ..... 248/519
5,685,518 A * 11/1997 Fox et al. ..... 248/519

FOREIGN PATENT DOCUMENTS

DE 217 285 1/1985
DE 40 13 371 C1 7/1991
DE 92 05 124.3 10/1992
DE 93 01 470.8 5/1993

OTHER PUBLICATIONS

Heron systemprofile, Katalog 1996, pp. 1.25–1.48.
Hilti Schienenmontage–System M., Feb. 11, 1991, 177–196.

* cited by examiner

*Primary Examiner*—Ramon O. Ramirez
*Assistant Examiner*—Holly N. Sy
(74) *Attorney, Agent, or Firm*—Michael J. Striker

(57) ABSTRACT

A base (80*a*) for fastening profiled rods (35, 40, 70) is proposed. The base (80*a*) is comprised of a sole plate (85*a*) and two walls (90*a*, 95*a*) formed onto the sole plate (85*a*), which are disposed at an angle to each other and at least partially define at least one flat section (130, 185, 210) on the sole plate (85*a*). The walls (90*a*, 95*a*) can be fastened to at least one profiled rod (35, 40, 70). At least one wall (90*a*, 95*a*) has a first wall section (100, 110) and a second wall section (175, 180), wherein the respective wall sections (100, 110, 175, 180) define different sized flat sections (130, 185, 210), which are adapted to different sized profiled rods (35, 40, 70). In this manner, one base (80*a*) can be used for different sized profiled rods (35, 40, 70).

12 Claims, 3 Drawing Sheets

BASE FOR SECURING SHAPED RODS

PRIOR ART

The Invention is based on a base for fastening profiled rods according to the preamble to the main claim. Bases of this kind are used in fastening profiled rods that serve as supports for protective fences or dividing walls around industrial manufacturing apparatuses, such as robots. Such bases for fastening profiled rods are comprised of a sole plate and two walls formed onto the sole plate that are disposed at an angle to each other. The walls at least partially define a flat section on the sole plate. The walls can furthermore be fastened to at least one profiled rod. If a smaller profiled rod is fastened, then the sole plate of the base protrudes, as a result of which the base represents a stumbling point. Consequently, only profiled rods of a particular size can be fastened to a base of this kind. Therefore other bases are required for another size. As a result, the number of different bases increases, which increases inventories.

In addition, a base is known which is comprised of a sole plate and two mounting angles that serve as reinforcing elements. In this instance, the sole plate is screwed to a surface, for example a floor of a factory hall, and the angles are screwed to both the sole plate and the profiled rod. Because of the use of the sole plate and the two mounting angles, the mounting becomes relatively costly. Furthermore, the profiled rod is fastened in the center of the sole plate. As a result, the sole plate protrudes beyond a boundary formed by a protective fence and consequently represents a stumbling point.

It is also known to fasten profiled rods to surfaces by means of hinged feet and foundation angles. However, there is an increased mounting cost here as well, due to the large number of parts.

Furthermore, another base plate is known, to which a profiled rod can be fastened in a number of positions. Consequently, the base plate can be prevented from protruding beyond the boundary formed by the protective fence. In this connection, however, the profiled rod is fastened to the base plate only by way of its end face. Since the profiled rod is not additionally supported laterally, however, only slight forces can be absorbed.

In addition, a sole plate with welded-on tabs is known. In this instance, a profiled rod is fastened between the tabs that are disposed in parallel. When the two tabs are welded onto the sole plate, particular attention must be paid to the fact that the distance must be precisely maintained and that the tabs are aligned parallel to one another. There is also the problem here that the sole plate protrudes beyond a boundary line formed by the dividing wall and consequently represents a danger point.

ADVANTAGES OF THE INVENTION

The base for fastening profiled rods according to the invention, with the characterizing features of the main claim, has the advantage over the prior art that the base can be used for profiled rods of various sizes, which among other things reduces storage costs. Also, the decision as to what kind of profiled rod should be used can be made on short notice at the building site. It is particularly advantageous to dimension the flat sections so that a square profiled rod with a first edge dimension, a square profiled rod with double the edge dimension, and a rectangular profiled rod with a single and a double edge dimension can be fastened since this corresponds, as a rule, to the commercially available graduations of profiled rods.

Other advantages and advantageous improvements of the base according to the invention ensue from the remaining dependent claims and the description.

The base according to the invention furthermore has the advantage that the mounting is simplified due to the smaller number of parts and high forces can nevertheless be transmitted. Through the use of two wall sections of the base, which are disposed at right angles to each other, to fasten the profiled rod, the profiled rod has a secure seating. If a through bore is disposed in the sole plate and is flush with a longitudinal bore embodied in the profiled rod, then the profiled rod can be additionally anchored. If through bores are embodied in the wall sections, then the profiled rod can be anchored by way of standard fastening means. If these through bores are embodied as oblong holes, then there is a larger degree of play available in the compensation for tolerances or a number of fastening screws can also be used to screw connect the profiled part. The base can be aligned in a particularly simple fashion by means of two marks respectively embodied on opposing side edges. The embodiment of raised flat sections on the underside of the base produces definite bearing points for the base. The base can be produced in a particularly inexpensive manner using the diecasting process. Using the base, a protective fence can be easily set up, which is stable and with which the danger of an accident due to stumbling is minimized.

DRAWINGS

An exemplary embodiment of the invention is depicted in the drawing and will be described in more detail in the description below.

DESCRIPTION OF THE EXEMPLARY EMBODIMENT

Figure 1:
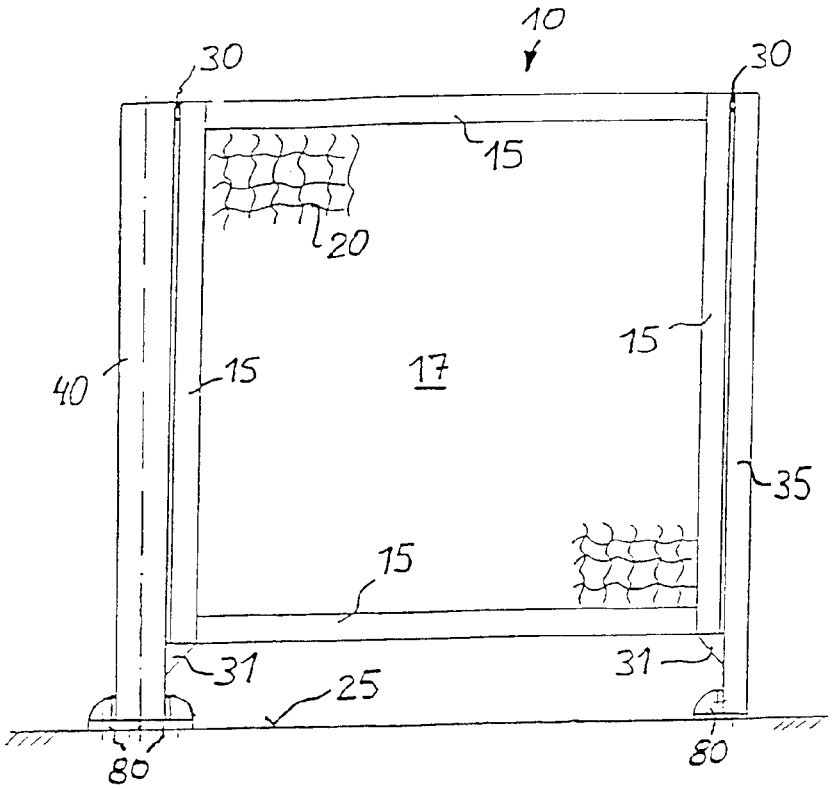
FIG. 1 is a front view of a segment of a protective fence.

FIG. 1 shows a protective fence segment 10 of the kind that is used to construct protective fences around industrial manufacturing apparatuses. A wire grating 20 is affixed in a rectangular frame 17 comprised of edge profiles 15. However, a plastic pane, for example, can also be affixed in lieu of the wire grating 20. The edge profiles 15 are screwed to one another. At a distance from a surface 25, for example a floor of a factory hall, the frame 17 is fastened with fastening means 30 and 31 between two supports disposed parallel to each other, which are comprised of a first profiled rod 35 and a second profiled rod 40. The supports that are comprised of the profiled rods 35 and 40 can be adjoined by other frames 17 at various angles so that any type of manufacturing apparatus can be completely encompassed.

Figure 2:
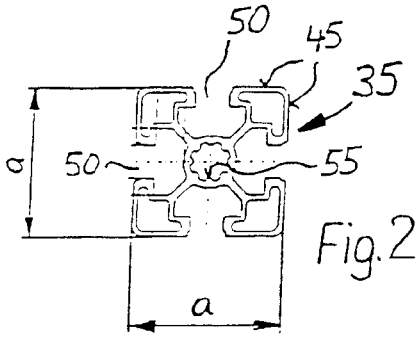
FIG. 2 shows the cross sectional area of a first profiled rod.

The profiled rod 35 shown in FIG. 2 has a cross sectional area whose outer contour is essentially square and has an edge dimension a. The profiled rod 35 has undercut grooves 50 along its longitudinal sides 45. A longitudinal bore 55 is embodied in the center of the profiled rod 35. Normally, a profiled rod 35 of this kind is manufactured using the aluminum extrusion process.

Figure 3:
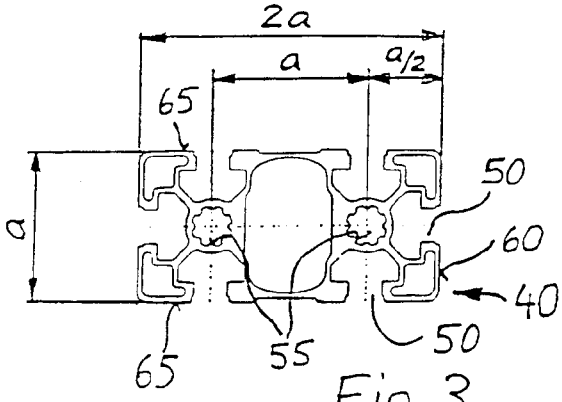
FIG. 3 shows the cross sectional area of a second profiled rod.

The cross sectional area of the outer contour of the profiled rod 40 depicted in FIG. 3 is essentially rectangular. The width of the opposing first longitudinal sides 60 is a and the width of the opposing second longitudinal sides 65 is 2a. An undercut groove 50 is embodied along each of the longitudinal sides 60. Along the longitudinal sides 65, two undercut grooves 50 are embodied whose symmetry axes have the distance a from each other and have the distance a/2 from the longitudinal sides 60. A longitudinal bore 55 is embodied between each pair of opposing grooves 50 of the two longitudinal sides 65. In addition, a larger hollow conduit is embodied between the two longitudinal bores 55.

Figure 4:
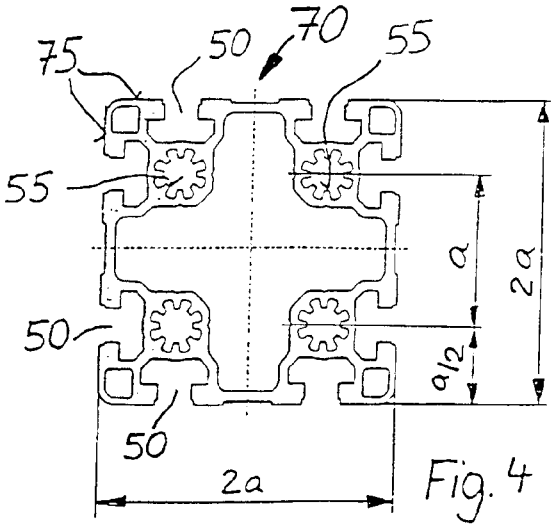
FIG. 4 shows the cross sectional area of a third profiled rod.

A third profiled rod 70 depicted in FIG. 4 demonstrates another possible modification. In this instance, the outer contour is once again square, with a respective edge dimension of 2a. Two undercut grooves 50 are embodied in each of the longitudinal sides 75, as in the profiled rod 40. Four longitudinal bores 55 are embodied in this profiled rod 70 and are likewise disposed symmetrically.

Other data about the intrinsically known profiled rods 35, 40, and 70 can be inferred from the catalog "Mechanik-Grundelemente" [Fundamentals of Mechanics], published '96/'97 by Robert Bosch GmbH, Stuttgart.

Figure 5:
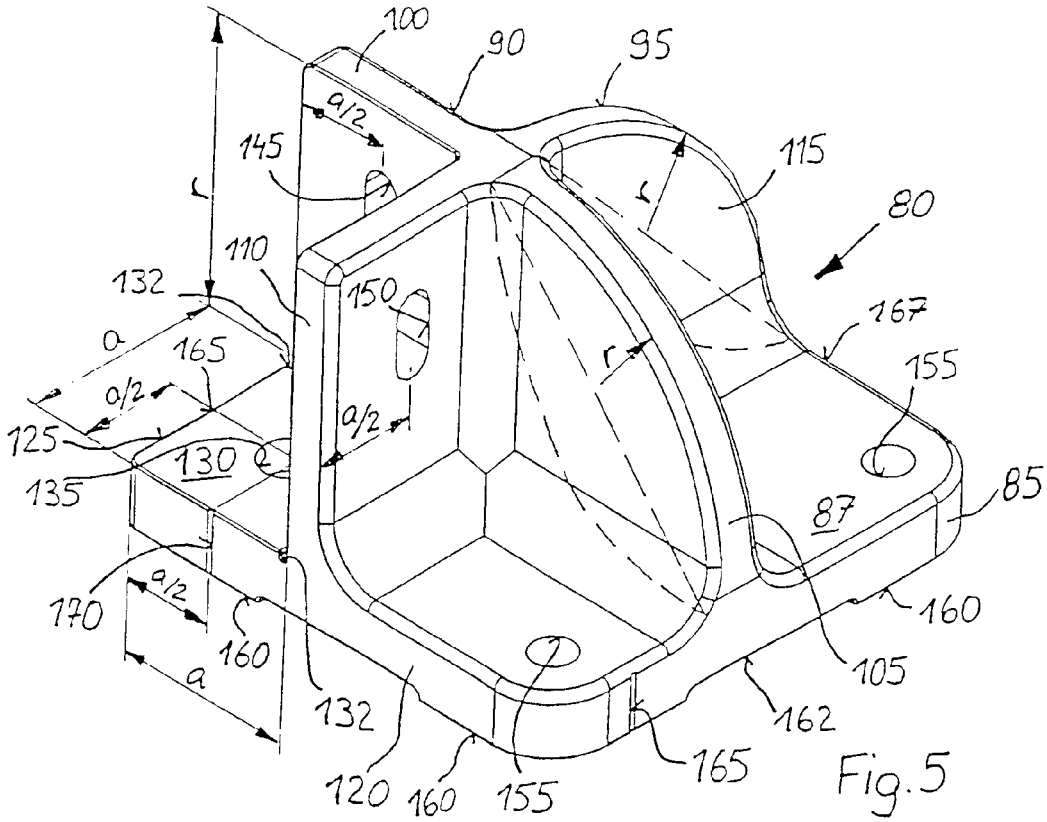
FIG. 5 is a first perspective view of a base.
Figure 6:
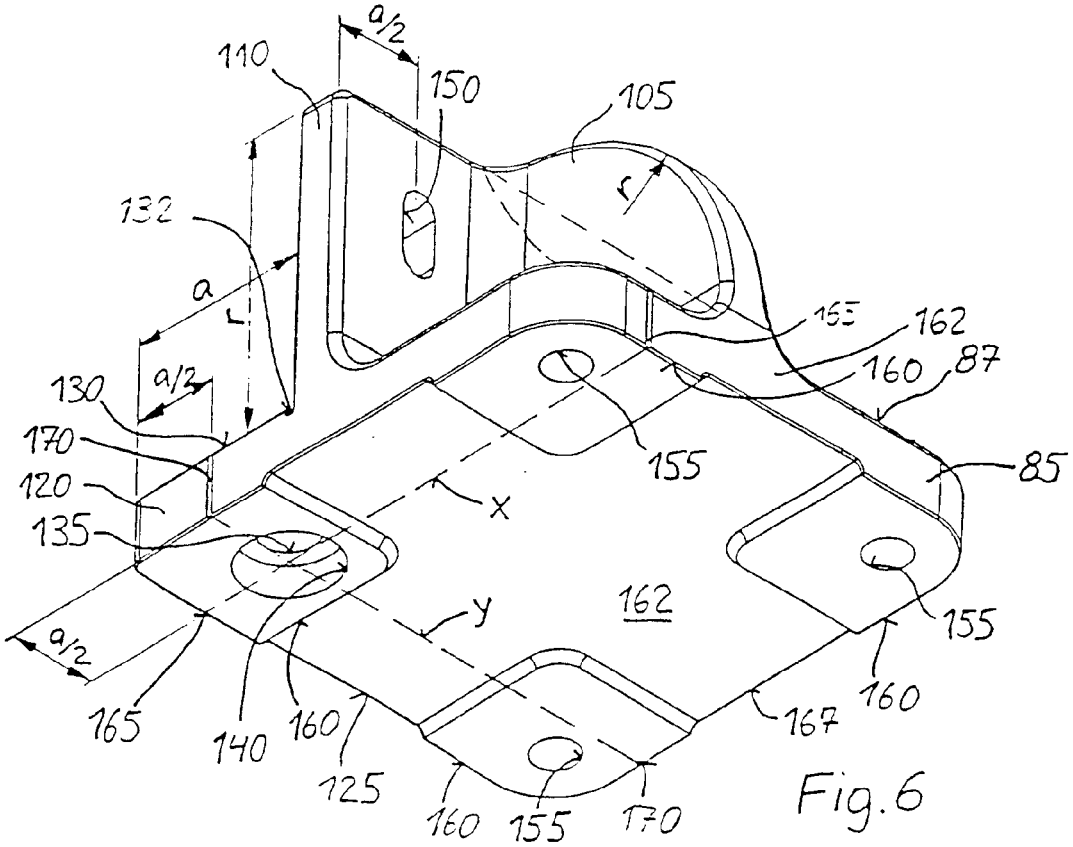
FIG. 6 is a second perspective view of the base.

The base 80 depicted in FIGS. 5 and 6 is used to anchor the profiled rods 35, 40, or 70 to the surface 25 and can be manufactured, for example, using the particularly inexpensive diecasting process. The base 80 is comprised of a sole plate 85 with an approximately square area and two walls 90 and 95 disposed on the top side 87, which protrude perpendicular to the sole plate 85 and are disposed at an angle to each other, wherein they also cross each other in perpendicular fashion in the current exemplary embodiment. The walls 90 and 95 extend over the entire width of the sole plate 85. The first wall 90 is comprised of a first wall section 100, which has a height r from the top side 87 of the sole plate 85. The first wall 90 is furthermore comprised of a fin 105, which adjoins the first wall section 100 at the point at which the first wall 90 crosses the second wall 95. The outer contour of the fin 105 has an arc with a radius r that ends flush with the side edge of the sole plate 85. The second wall 95 is likewise comprised of a first wall section 110 with a height r and an arc-shaped fin 115 that adjoins it and has the radius r. The distance of the first wall section 100 from a parallel side edge 120 of the sole plate 85 is a. The distance of the first wall section 110 of the wall 95, which is disposed at right angles to the first wall section 100 of the wall 90, from a parallel side edge 125 of the sole plate 85 is likewise a. Consequently, the two first wall sections 100 and 110 as well as the side edges 120 and 125 define a square flat section 130 of the sole plate 85, with an edge dimension of a. On the edges that the flat section 130 forms with the first wall section 100 and 110, respectively, small recesses 132 are embodied in the sole plate 85. At a distance of a/2 from the side edge 120 and a distance of a/2 from the side edge 125, i.e. in the center of the square flat section 130, a through bore 135 is a -provided. On the underside 137 of the sole plate 85, the first through bore 135 widens out into a counter bore 140 in which, for example, the head of a fillister-head screw can be disposed. In the first wall section 100, at a distance of a/2 from the side edge 125, a through bore is embodied in the form of a first oblong hole 145 that extends in the vertical direction. In the same manner, a second oblong hole 150 is likewise embodied in the first wall section 110, with a distance of a/2 from the side edge 120.

Besides in the corner region, which is formed by the side edges 120 and 125, the three remaining corner regions of the sole plate 85 have second through bores 155. On the underside 137 of the sole plate 85, raised flat sections 160 are formed around the first through bore 135 and the second through bores 155. With a distance of a/2 from the side edge 120, a mark 170 (sic) in the form of a notch is respectively embodied on the side edge 125 of the sole plate 85 and on the side edge 162 disposed parallel to and opposite from it. With a distance of a/2 from the side edge 125, an additional mark 170 in the form of a notch is respectively embodied on the side edge 120 of the sole plate 85 and on the side edge 167 disposed parallel to and opposite from it. The first through bore 135 is disposed at the intersecting point of two straight lines x and y, which starting from the marks 165 and 170, respectively extend parallel to the intersecting points 120 and 125.

In order to anchor the profiled rod 35 to the surface 25, the profiled rod 35 is first brought with two of its longitudinal sides 45 in contact with the first wall sections 100 and 110 of the base 85. An end face of the profiled rod 35 thus rests against the flat section 130. A bur on the end face of the profiled rod 35 possibly produced when cutting to length can be partially received in the recesses 132. Since both the edge dimension of the outer contour of the cross sectional area of the profiled rod 35 and the edge dimension of the square flat section 130 are each a, the two longitudinal sides 45 of the profiled rod 35 that point away from the first wall sections 100 and 110, end flush with the side edges 120 and 125 of the sole plate 85. Due to the respective central disposition of the longitudinal bore 55 in the profiled rod 35 and of the through bore 135 in the square flat section 130, the respective longitudinal axes coincide with each other. Consequently, a fastening screw can be guided through the through bore 135 from the underside of the sole plate 85 and can be screwed into the longitudinal bore 55 of the profiled rod 35. Since the center spacing of the oblong holes 145 and 150 from the side edges 125 and 120 is a/2, the two oblong holes 145 and 150 each cooperate with an undercut groove 50 of a longitudinal side 45 of the profiled rod 35. Consequently, the profiled rod 35 is fastened to the first wall sections 100 and 110, for example by means of fillister-head screws and hammer nuts or similarly acting fastening means. The standard fastening means described above are known from the previously mentioned catalog "Mechanik-Grundelemente" from Robert Bosch GmbH.

In order to erect a protective fence around a manufacturing apparatus, first, lines are drawn on the surface 25, along which the individual protective fence segments 10 are to be erected. At the points at which supports for the individual frames 17 are to be placed, hash marks are drawn perpendicular to the lines drawn previously. Then the bases 80 are placed on the surface 25 so that for example the marks 165 coincide with the lines and so that the marks 170 coincide with the hash marks. Since the through bore 135 is also disposed at the respective intersecting point of the lines x and y formed by the two marks 165 and 170, the through bore 135 is disposed directly over the intersecting point of the line and the hash mark. Since the longitudinal axis of the longitudinal bore 55 of the profiled rod 35 also coincides with the through bore 135, the profiled rod 35 that is used as a support is exactly aligned. If a base 80 is positioned, then marks can be made through the through bores 155. Then holes are bored into the surface 25 into which anchoring peg are inserted. Then the base 80 is anchored to the surface 25 using screws that are introduced through the through bores 155. If it is necessary to alter the vertical position of the profiled rod 35, then, for example, plain washers can also be inserted between the square flat section 130 and the end face of the profiled rod 35. If the angular position of the profiled rod 35 must also be changed, then this usually occurs through the insertion of plain washers between the surface 25 and the flat sections 160.

All of the bases 80 of a protective fence are aligned so that they point with the fins 105 and 115 toward the inside of the closed protective fence. As a result, there are no stumbling points that protrude beyond the boundary formed by the protective fence. Two protective fence segments 10 disposed next to each other can thus be aligned so that an angle thus formed is, as a rule, between 90° and 180°.

To mount a profiled rod 50, which has twice the width of the profiled rod 35, two bases 80 can be used. An end face of the profiled rod 40 thus rests half-way on a square flat section 130 of a base 80. This results in the fact that the two longitudinal bores 55 of the profiled rod 40 coincide with the through bores 135 of the two bases 80. Furthermore, a longitudinal side 65 and the two longitudinal sides 60 of the profiled rod 40 rest against the corresponding first wall sections 100 and 110 of the two bases 80. Since four undercut grooves 50 now cooperate with the corresponding oblong holes 145 and 150, the profiled rod 40 can be fastened in a particularly stable manner using additional fastening means. Consequently, profiled parts 40 like the one shown in FIG. 1 can be disposed at heavily loaded points of a protective fence.

Four bases 80 can be used when mounting a profiled rod 70. These bases are respectively placed so that the four square flat sections 130 also produce a square surface that corresponds to the square outer contour of the cross sectional area of the profiled rod 70. This also produces four pairs of coinciding longitudinal bores 55 and through bores 135. Eight pairs of oblong holes 145 and 150 and the corresponding undercut grooves 50 in the longitudinal sides 75 of the profiled rod 70 are also produced. By way of the through bores 155, the profiled rod 70 can then be anchored to the surface 25 using four to twelve screws as needed. The profiled rod 70 anchored in such a way can, for example, also be used as a component of a crane.

In FIG. 5, the dashed lines show how the outer contour of the arc-shaped fins 105 and 115 can be alternatively shaped. The outer contour can, for example, be embodied as concave instead of convex. The fins can also be provided with a straight outer contour. Since the fins 105 and 115 shown have the outward arc, for example correspondingly shaped caps can be constructed, which can cover screw heads of screws disposed in the through bores 155. Consequently the risk of accident is further reduced. If the mechanical stresses are not too high, it is also conceivable to eliminate the fins 105 and 115 entirely. In the case of low stresses, it is also conceivable to embody only one first wall section 100 or 110 instead of the two first wall sections 100 and 110. Another modification of the first wall sections 100 and 110 can be comprised in that no oblong holes 145 and 150 are embodied and instead of these, protrusions are formed onto the first wall sections 100 and 110, which have a cross sectional area that corresponds to the undercut groove 50 in a longitudinal side of a profiled rod 35, 40, 70. This embodiment, however, requires tighter tolerances. This is necessary since on the one hand, the parts must slide along one another during assembly and since on the other hand, the parts should not have to much play.

It is also conceivable that the form of the sole plate 85 is not rectangular or square, but while retaining the two straight side edges 120 and 125 that are perpendicular to each other, corresponds to a quarter of a circle.

Figure 7:
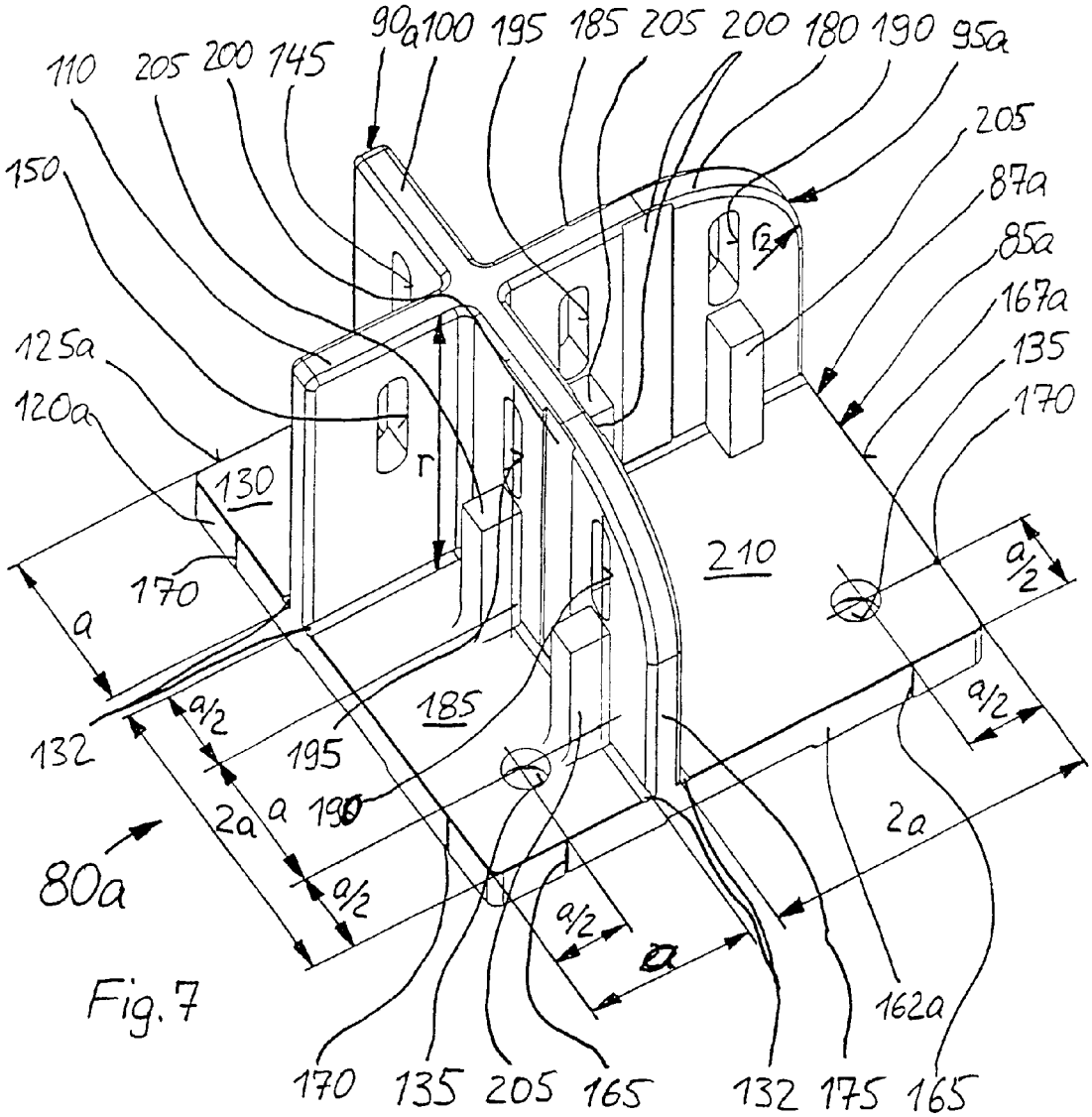
FIG. 7 is a perspective view of a modified base.

FIG. 7 shows a base 80*a* that can be used in a particularly versatile manner for fastening profiled rods 35, 40, or 70 to the surface 25. The base 80*a* is comprised of a sole plate 85*a* with an approximately square area and two walls 90*a* and 95*a* disposed on the top side 87*a*, which protrude perpendicular to the sole plate 85*a* and also cross each other in a perpendicular fashion. The walls 90*a* and 95*a* extend over the entire width of the sole plate 85*a*. The first wall 90*a* is comprised of a first wall section 100, which has a height r from the top side 87*a* of the sole plate 85*a*. The first wall 90*a* is furthermore comprised of a second wall section 175, which adjoins the first wall section 100 at the point at which the first wall 90*a* crosses the second wall 95*a*. The outer contour of the second wall section 175 of the wall 90*a* has an arc with a radius $r_2$ whose magnitude is less than the height r. The second wall 95*a* is likewise comprised of a first wall section 110 with a height r and a second wall section 180 that adjoins it and has the radius $r_2$. It is also possible that the two first wall sections 100 and 110 have arcs with a radius of $r_2$.

The distance of the first wall section 100 from a parallel side edge 120*a* of the sole plate 85*a* is a. The distance of the first wall section 110 of the wall 95*a*, which is disposed at right angles to the first wall section 100 of the wall 90*a*, from a parallel side edge 125*a* of the sole plate 85*a* is likewise a. Consequently, the two first wall sections 100 and 110 as well as the side edges 120*a* and 125*a* define a square flat section 130 of the sole plate 85*a*, with an edge dimension of a. At the edges that the flat section 130 forms with the first wall section 100 and 110, respectively, small recesses 132 are embodied in the sole plate 85*a*. A through bore 135 is embodied in the flat section 130 of the base 80*a* just as in the base 80.

In the first wall section 100, at a distance of a/2 from the side edge 125*a*, a through bore is embodied in the form of a first oblong hole 145 that extends in the vertical direction. In the same manner, a second oblong hole 150 is likewise embodied in the first wall section 110, with a distance of a/2 from the side edge 120*a*.

The distance of the second wall section 175 from a parallel side edge 120*a* of the sole plate 85*a* is a. The distance of the wall section 110, which is disposed at right angles to the wall section 175, from a parallel side edge 162*a* of the sole plate 85*a* is 2a. Consequently, the two wall sections 175 and 110 as well as the side edges 120*a* and 162*a* define a rectangular flat section 185 of the sole plate 85*a* with an edge dimension of a×2a. At the edges that the flat section 185 forms with the wall section 110 and 175, respectively, small recesses 132 are embodied in the sole plate 85*a*. A through bore 135 is embodied in the flat section 185 of the base 80*a* just as in the flat section 130.

In the wall section 175, at a distance of a/2 from the side edge 162*a*, a through bore is embodied in the form of a first oblong hole 190 that extends in the vertical direction. An oblong hole 195 is embodied at a distance a from the oblong hole 190 and parallel to it. A recess 200 is embodied in the second wall section 175, in the center between the oblong holes 190, 195, which advantageously permits a more precise installation of profiled rods 40 against the wall section 175. Ideally, protrusions 205 can be formed onto the wall section 175 between the flat section 185 and the oblong holes 190, 195 and these protrusions 205 can be disposed with form fit in the groove throats of the grooves 50 of the profiled rods 35, 40, 70. The protrusions 205 can also have a cross sectional shape that corresponds to that of the grooves 50. This permits a particularly secure connection between the profiled rods 35, 40, The first wall section 100 of the wall 90*a* and the second wall section 180 of the wall 95*a* likewise define a flat section 185 and are embodied precisely the same as the wall sections 110 and 175. Due to the disposition of the two rectangular flat sections 185, the base 80*a* can be used for a door whose frame is comprised of rectangular profiled rods 40 so that no stumbling point is produced.

The distance of the second wall section 175 from a parallel side edge 167*a* of the sole plate 85 is 2a. The distance of the second wall section 180 of the wall 95*a*, which is disposed at right angles to the second wall section 175 of the wall 90*a*, from a parallel side edge 162*a* of the sole plate 85*a* is likewise 2a. Consequently, the two second wall sections 175 and 180 as well as the side edges 162*a* and 167*a* define a square flat section 210 of the sole plate 85*a* with an edge dimension of 2a. At the edges which the flat section 210 forms with the second wall section 175 and 180, respectively, small recesses 132 are embodied in the sole plate 85*a*. Recesses 200 are embodied centrally between the oblong holes 195 and 190 of the wall sections 175 and 180. Protrusions 205 can likewise be provided between the oblong holes 195 and 200 as well as on the flat section 210. A through bore 135 is embodied in the flat section 210 of the base 80*a*, just as in the base 80, and the distance of this through bore 135 from the side edge 162*a* and 167*a* is a/2.

One profiled rod 35 can be mounted with the flat section 130 of the base 80*a*, one profiled rod 40 can be mounted with the two flat sections 185, and one profiled rod 70 can be mounted with the flat section 210. Thus three different profiled rods 35, 40, 70 can be mounted using one base 80*a*. This is possible due to the fact that two or more walls 90*a*, 95*a* formed on to the sole plate 85*a* are provided, which are disposed at an angle to each other and which at least partially define at least one flat section 130, 185, 210 on the sole plate 85*a*. The walls do not absolutely have to be disposed at right angles to each other. With profiled rods that have a triangular cross sectional area, the walls can then be disposed at corresponding angles to one another. However, for the sake of greater mechanical strength, the walls should be able to be fastened to at least one profiled rod 35, 40, 70. According to the invention, at least one wall 90*a*, 95*a* has a first wall section 100, 110 and a second wall section 175, 180. The respective wall sections 100, 110, 175, 180 define flat sections 130, 185, 210 of different sizes, which for their part are adapted to various sized profiled rods (35, 40, 70). In this connection, "adapted" means that the flat sections 130, 185, 210 of the sole plate 85*a* do not protrude significantly beyond a mounted profiled rod 35, 40, 70, i.e. in the millimeter range, ideally up to approx. 1 mm. As a result, the sole plate 85*a* advantageously does not protrude beyond a boundary formed by a protective fence and consequently does not represent a stumbling bar point. However, this also results in the fact that the flat sections can be of such a size that a profiled rod 35, 40, 70 can protrude beyond the sole plate 85*a* since this does not involve the danger of an accident.

Advantageously, each wall 90*a*, 95*a* has a first wall section 100, 110 and a second wall section 175, 180, which increases the number of profiled rods 35, 40, 70 that can be fastened.

With conventional profiled rods 35, 40, 70 that have a rectangular outer contour of the cross sectional area, it is ideal if the walls 90*a*, 95*a* are also disposed at right angles to each other and the wall sections 100, 110, 175, 180 define at least one flat section 130, 185, 210 with four side edges 120*a*, 125*a*, 162*a*, 167*a* disposed at right angles to one another.

This is optimized first by virtue of the fact that a first flat section 130 defined by the two first wall sections 100, 110 is embodied as square and that the edge dimension a of the first flat section 130 corresponds to the edge dimension a of one side of the outer contour of the cross sectional area of a first profiled rod 35. Second, the first wall sections 100, 110 and second wall sections 175, 180 define two flat sections 185, which are embodied as rectangular since an edge dimension a of the second flat section 185 corresponds to the first edge dimension of a second profiled rod 40 and the second edge dimension 2a of the second flat section 185 corresponds to the second edge dimension 2a of the second profiled rod 40. Third, the two second wall sections 175, 180 define a flat section 210, which is A embodied as square and whose edge dimension 2a corresponds to the edge dimension 2a of a side of the outer contour of the cross sectional area of a third profiled rod 70. It is consequently advantageous to dimension the flat sections 130, 185, 210 so that a square profiled rod 35 with a first edge dimension a, a square profiled rod 70 with a double edge dimension 2a, and a rectangular profiled rod 40 with a single edge dimension a and a double edge dimension 20 can be fastened since as a rule, this corresponds to the commercially available graduations of profiled rods 35, 40, 70. However, it is also possible to provide other ratios in lieu of single and double edge dimensions a and 2a.

By using the base 80*a*, the user can also make a decision on short notice at a building site as to what kind of profiled rod 35, 40, or 70 should be used—depending on the load.

A number of profiled rods 35, 40, 70 can be attached simultaneously to a base 80*a* that is fastened to a surface 25. This can be advantageous if a base 80*a* is intended to be placed at a corner of a protective fence and adjoins another enclosed protective fence, wherein the base 80*a* is likewise placed at a corner of this other protective fence. To this end, the through bores 135 can also have a counter bore 140 for a screw head, from the side of the flat sections 130, 185, 210. As a result, the base 80*a* can be fastened to a surface 25 without the screw heads protruding beyond the flat sections 130, 185, 210.

What is claimed is:

1. A base (80*a*) for fastening profiled rods (35, 40, 70), which is comprised of a sole plate (85*a*) and a number of walls (90*a*, 95*a*) that are formed onto the sole plate (85*a*), wherein the walls (90*a*, 95*a*) are disposed at an angle to one another and at least partially define at least one flat section (130,185, 210) on the sole plate (85*a*) and wherein the walls (90*a*, 95*a*) can be fastened to at least one profiled rod (35, 40, 70), at least one wall (90*a*, 95*a*) has a first wall section (100, 110) and a second wall section (175, 180), [that] the respective wall sections (100, 110, 175, 180) define different sized flat sections (130,185, 210), and that the different sized flat sections (130, 185, 210) are adapted to different sized profiled rods (35,40, 70), in each of the wall sections (100, 110, 175, 180) at least one throughgoing hole (145,150, 190,195) which extends perpendicular to the wall portion (100, 110, 175, 180) is arranged so that through the throughgoing holes (145,150, 190,195) mounting elements are insertable for engagement in undercut grooves (50) of the profiled rods (35, 40, 70).

2. The base (80*a*) according to claim 1, characterized in that the walls (90*a*, 95*a*) are disposed at right angles to each other and that the wall sections (100, 110, 175, 180), together with four side edges (120*a*, 125*a*, 162*a*, 167*a*) disposed at right angles to one another, define at least one flat section (130, 185, 210).

3. The base (80*a*) according to claim 1, characterized in that a first flat section (130), which is defined by the two first wall sections (100, 110), is embodied as square, that two flat sections (185), which are respectively defined by a first wall section (100, 110) and a second wall section (175, 180), are embodied as rectangular, and that a third flat section (210), which is defined by the two second wall sections (100, 110), is embodied as square.

4. A The base **(80*a*) according to claim 3, characterized in that the edge dimension (a) of the square first flat section (130) corresponds to an edge dimension (a) of a first square profiled rod (35), that an edge dimension (a) of the rectangular second flat sections (185) corresponds to a first edge dimension (a) of a rectangular profiled rod (40) and the second edge dimension (2a) of the second flat section (185) corresponds to a second edge dimension (2a) of the second profiled rod (40), and that the edge dimension (2a) of the square third flat section (210) corresponds to an edge dimension (2a) of a second square profiled rod (70)**.

5. The base **(80*a*) according to claim 1, characterized in that at least one through bore (135) with a counter bore (140) is embodied in the sole plate (85*a*), through which a fastening element can be guided to engage in a longitudinal bore (55) of a profiled rod (35, 40, 70)**.

6. The base **(80*a*) according to claim 1, characterized in that pairs of marks (165, 170) are embodied on the side edges (120*a*, 125*a*, 162*a*, 167*a*) of the sole plate (85*a*)** as mounting aids.

7. The base **(80*a*) according to claim 1, characterized in that through bores (135, 155) for anchoring means are embodied for the anchoring of the base (80*a*) to a surface (25)**.

8. The base **(80*a*) according to claim 7, characterized in that the through bores (135, 155) have counter bores for screw heads from the side of the flat sections (130, 185, 210)**.

9. The base **(80*a*) according to claim 1, characterized in that raised flat sections (160) are embodied on the underside (137) of the base (80*a*)**.

10. A protective fence comprised of profiled rods (35, 40, 70), which are disposed in parallel fashion and are anchored to a surface (25) with bases **(80*a*) according to claim 1, and frames (17) disposed between the profiled rods (35, 40, 70) by means of fastening elements (30, 31)**.

11. A base (88) according to claim 1, wherein the throughgoing holes are formed as oblong holes.

12. A base **(80*a*)for fastening profiled rods (35,40,70), which is comprised of a sole plate (85*a*) and a number of walls (90*a*, 95*a*) that are formed onto the sole plate (85*a*), wherein the walls (90*a*, 95*a*) are disposed at an angle to one another and at least partially define at least one flat section (130, 185, 210) on the sole plate (85*a*) and wherein the walls (90*a*, 95*a*) can be fastened to at least one profiled rod (35, 40, 70), at least one wall (90*a*, 95*a*) has a first wall section (100, 110) and a second wall section (175, 180), the respective wall sections (100, 110, 175, 180) define different sized flat sections (130,185, 210), and that the different sized flat sections (130, 185,210) are adapted to different sized profiled rods (35,40, 70), in each of the wall sections (100, 110, 175, 180) at least one throughgoing hole (145,150, 190,195) which is formed as an oblong hole extending in a vertical direction through the wall portion (100, 110, 175, 180) is arranged so that through the throughgoing holes (145, 150, 190, 195) mounting elements are insertable for engagement in undercut grooves (50) of the profiled rods (35, 40, 70)**.

* * * * *